US010293996B2

(12) United States Patent
Van Rixel et al.

(10) Patent No.: US 10,293,996 B2
(45) Date of Patent: May 21, 2019

(54) SECURITY COVER FOR BEVERAGE CANS AND OTHER CONTAINERS

(71) Applicants: Scott Van Rixel, Miami, FL (US); Benjamin L. Sitler, Miami Beach, FL (US); Justin Stevens, Pembroke Pines, FL (US)

(72) Inventors: Scott Van Rixel, Miami, FL (US); Benjamin L. Sitler, Miami Beach, FL (US); Justin Stevens, Pembroke Pines, FL (US)

( * ) Notice: Subject to any disclaimer, the term of this patent is extended or adjusted under 35 U.S.C. 154(b) by 382 days.

(21) Appl. No.: 15/148,438

(22) Filed: May 6, 2016

(65) Prior Publication Data

US 2017/0320647 A1 Nov. 9, 2017

(51) Int. Cl.

| | |
|---|---|
| ***B67B 7/00*** | (2006.01) |
| ***B65D 17/28*** | (2006.01) |
| ***B65D 55/14*** | (2006.01) |
| ***B65D 43/02*** | (2006.01) |
| ***B65D 41/02*** | (2006.01) |
| ***B65D 50/00*** | (2006.01) |
| ***B65D 50/06*** | (2006.01) |
| ***B65D 51/20*** | (2006.01) |

(Continued)

(52) U.S. Cl.

CPC ..... *B65D 55/14* (2013.01); *B65D 17/4012* (2018.01); *B65D 41/023* (2013.01); *B65D 43/0212* (2013.01); *B65D 50/00* (2013.01); *B65D 50/067* (2013.01); *B65D 51/20* (2013.01); *B65D 55/00* (2013.01); *B67B 7/00* (2013.01); *B65D 2251/0028* (2013.01); *B65D 2251/0071* (2013.01); *B65D 2517/0014* (2013.01); *B65D 2517/0098* (2013.01); *B65D 2543/00092* (2013.01); *B65D 2543/00722* (2013.01); *B65D 2543/00842* (2013.01); *B65D 2543/00972* (2013.01); *B67B 7/16* (2013.01)

(58) Field of Classification Search

CPC .. B65D 55/14; B65D 43/0212; B65D 41/023; B65D 50/00

USPC ..... 220/274, 275, 284, 285, 286; 215/215, 215/302, 303, 304, 390

See application file for complete search history.

(56) References Cited

U.S. PATENT DOCUMENTS 2,275,426 A * 3/1942 Gray ..... B65D 43/0233 220/284

3,638,819 A 2/1972 Roy (Continued)

FOREIGN PATENT DOCUMENTS

EP 0118099 A2 9/1984

EP 0302969 A1 2/1989

(Continued)

*Primary Examiner* — Jeffrey R Allen

(74) *Attorney, Agent, or Firm* — Rod D. Baker

(57) ABSTRACT

A security cover system and apparatus for beverage cans and other containers. The system includes a security cap that is installed upon the top of an unopened container for containing an adult beverage or the like. The cap is adapted for secure installation upon the top of a container having a top with a circumferential rim, such as an aluminum beverage can. The cap has catches engagable with the rim of the container. The system includes an opener tool with a specially shaped key portion thereon. The opener engages with a complementary slot in the cap to permit an authorized person, using the opener tool, to remove the cap from the container.

24 Claims, 7 Drawing Sheets

(51) Int. Cl.
*B65D 55/00* (2006.01)
*B67B 7/16* (2006.01)

(56) References Cited

U.S. PATENT DOCUMENTS

| | | | | |
|---|---|---|---|---|
| 3,679,085 | A | 7/1972 | Gach | |
| 3,685,676 | A | 8/1972 | Gach et al. | |
| 3,837,518 | A | 9/1974 | Gach | |
| 4,177,930 | A * | 12/1979 | Crisci | B65D 43/0212 220/284 |
| 5,509,550 | A | 4/1996 | DeJonge | |
| 6,263,761 | B1 | 7/2001 | Ryder | |
| 7,025,220 | B2 * | 4/2006 | Verespej | B65B 61/186 206/233 |
| 7,588,275 | B2 | 9/2009 | Borg | |
| 8,863,947 | B2 | 10/2014 | Sibley | |
| 2006/0213912 | A1 | 9/2006 | Zaytoun | |
| 2009/0250462 | A1 | 10/2009 | Haimi | |
| 2016/0107796 | A1 | 4/2016 | Sibley | |

FOREIGN PATENT DOCUMENTS

| | | | |
|---|---|---|---|
| WO | 2005021398 | A2 | 3/2005 |
| WO | 2009089602 | A1 | 7/2009 |

* cited by examiner

SECURITY COVER FOR BEVERAGE CANS AND OTHER CONTAINERS

BACKGROUND OF THE INVENTION

Technical Field

The present invention relates generally to the field of caps or lids for containers, and has specifically to do with a security cap or cover for removable installation upon a container, such as a personal beverage container, to limit access to the contents of the container.

Description of Background Art

It is known to provide security to certain types of small containers, particularly drug and medicine bottles, through the use of specialized caps and lids. Drug and medicine bottles may contain substances that are harmful in overdose amounts, and thus must be secured against opening by unauthorized or unqualified persons such as children or the mentally handicapped. Most conventional security or "child-proof" caps involve a threaded cap that has screwed engagement with the threaded neck of a small bottle; the user typically must squeeze the cap in a very specialized manner, and/or push down upon the cap, in order to unscrew the cap from the bottle. While such systems have advantages, they nevertheless often can be opened by any person having sufficient manual dexterity and strength. Also, threaded security caps for screwed engagement with containers are poorly suited for use with containers other than small plastic bottles such as pill and medicine bottles.

There are occasions when it is desirable to prevent an unauthorized person from obtaining access to a container, regardless of the person's hand strength. For example, it is desirable to prevent certain persons from being able to open a container larger than a medicine bottle, for instance, a beverage can. Containers, such as beverage cans, may contain substances, for example alcoholic beverages or other drinks, access to which should be denied to certain persons, e.g., minors or addicts. There are a variety of potential reasons for limiting access to selected containers to authorized persons only, including the need to prevent misuse or theft of container contents. It would be desirable to have some means and method for providing security to conventional containers such as, for example, beverage cans, to control access to container contents. Such a means and method preferably is easily installed upon the top of a container, and removed there from, and ideally can be-reinstalled upon the container if desired. There is unmet need for such a security cover for beverage cans and other containers, particularly a "child-proof" cap or lid that can be opened only by an authorized person.

Against the foregoing background, the presently disclosed apparatus was invented.

SUMMARY OF THE DISCLOSURE

There is disclosed a security cover system and apparatus for beverage cans and other containers. The system includes a security cap that is installed upon the top of an unopened container for containing an adult beverage or other sensitive or special contents. The cap is adapted for secure installation upon the top of a container (e.g., cylindrical container) having a top with a perimetric or circumferential rim, such as aluminum, aluminum alloy, or other metal alloy beverage can. The cap has at least one, preferably three, hooked catches that are firmly and reliably engaged with the circumferential or perimetric rim of the container. The system includes an opener tool, to be grasped by a user, with a specially shaped key portion thereon. The security cap has a key slot concavity or slot defined therein, into which the opener key can be selectively inserted. With the opener key held within the cap's key slot, the opener may be manually lifted by the user, to function as a lever, for mildly bending the cap to disengage the hooked catch(es) from the container's rim, thereby to release the cap from the top of the container. Only after the authorized user, employing the proper opener key, has released the security cap from the top of the container may the user obtain access to the conventional openings in the container's top in order to obtain entry into the container interior.

The security cap may be provided with an interior sealing gasket. The gasket is optional, but desirable in applications where the cap is re-installed upon a container from which it has previously been removed, and thus seals the open container against leakage of container contents.

An object of the present invention is to provide a container security system that limits access to the contents of a container.

Another object of the present invention is to provide a system that allows an authorized person, but only an authorized person, to open a container that contains sensitive or controlled substances. In use, the present invention is believed to provide a lawfully adequate "child-proof" cover for a container.

Another object of the present invention is to provide a container security system that is easily and affordably fabricated.

Another object of the present invention is to provide a container security system that can be installed upon containers having a perimetric or circumferential rim around the top of the container.

Another object of the present invention is to provide a container security system that can be installed upon a container, removed from the container, and then re-installed upon the container to renew the security of the container against unauthorized opening.

An advantage of the present invention is that it provides container security regardless of the manual strength or dexterity of the user.

Another advantage of the present invention is that it does not employ a threaded, screwed, connection between a lid and its container.

Another advantage of the present invention is that it prohibits ready access to the contents of a secured container to any person not having an appropriate opener tool.

Another advantage of the present invention is that its security caps can be easily installed upon the tops of many containers at the time of mass container fabrication and filling at a production facility.

Another advantage of the present invention is that when the security system is installed upon an unopened container, it does not unduly interfere with the storage and shipping of the secured container.

Another advantage of the present invention is that it may be used to reseal an opened container to prevent leakage of container contents.

Other objects and advantages of the system, apparatus, and method of the present invention shall be apparent from the following specification.

BRIEF DESCRIPTION OF DRAWINGS

Illustrative embodiments that incorporate one or more features according to the invention are described with reference to the following drawings. The drawings are not necessarily to scale, and scale may vary between figures. Like numerals are used among the several views to label like elements and components. The drawings illustrate, but do not strictly delimit, embodiments of the invention. In the drawings.

DETAILED DESCRIPTION OF A PREFERRED EMBODIMENT

Figure 1:
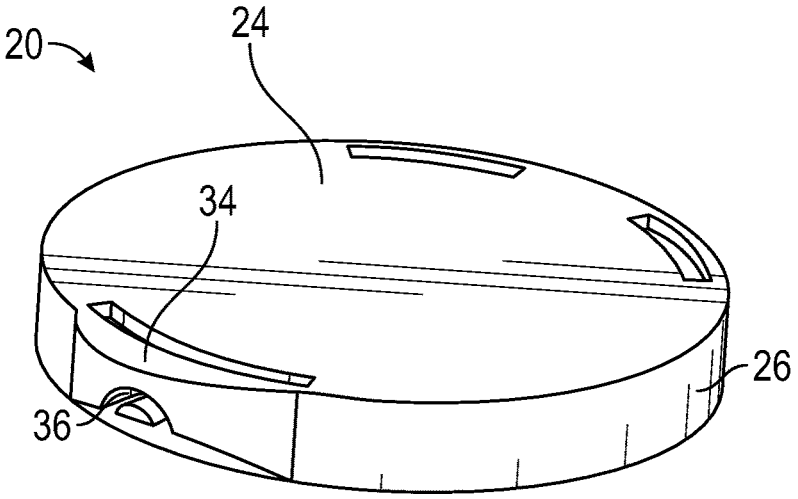
FIG. 1 is a top perspective view of a security cap of an apparatus according to the present disclosure.

In the following detailed description, a preferred embodiment is described in sufficient detail so as to enable one skilled in the art to practice the invention. It is understood that other embodiments may be devised, and that logical, mechanical, material and various other assemblies may be made without departing from the scope of the present invention. The following description therefore, is to disclose the invention but not necessarily to limit its scope.

Thus, while this invention is susceptible of embodiment in many different forms, there is shown in the drawings and will be described in detail, specific embodiments with the understanding that the present disclosure is to be considered as an exemplification of the principles of the invention and is not intended to limit the invention to the embodiments illustrated.

It also should be understood that like or analogous elements and/or components, referred to herein, are identified throughout the drawings by like reference characters. In addition, it should be understood that the drawings are primarily symbolic and are only meant to aid in understanding the ideas and concepts disclosed.

Figure 5:
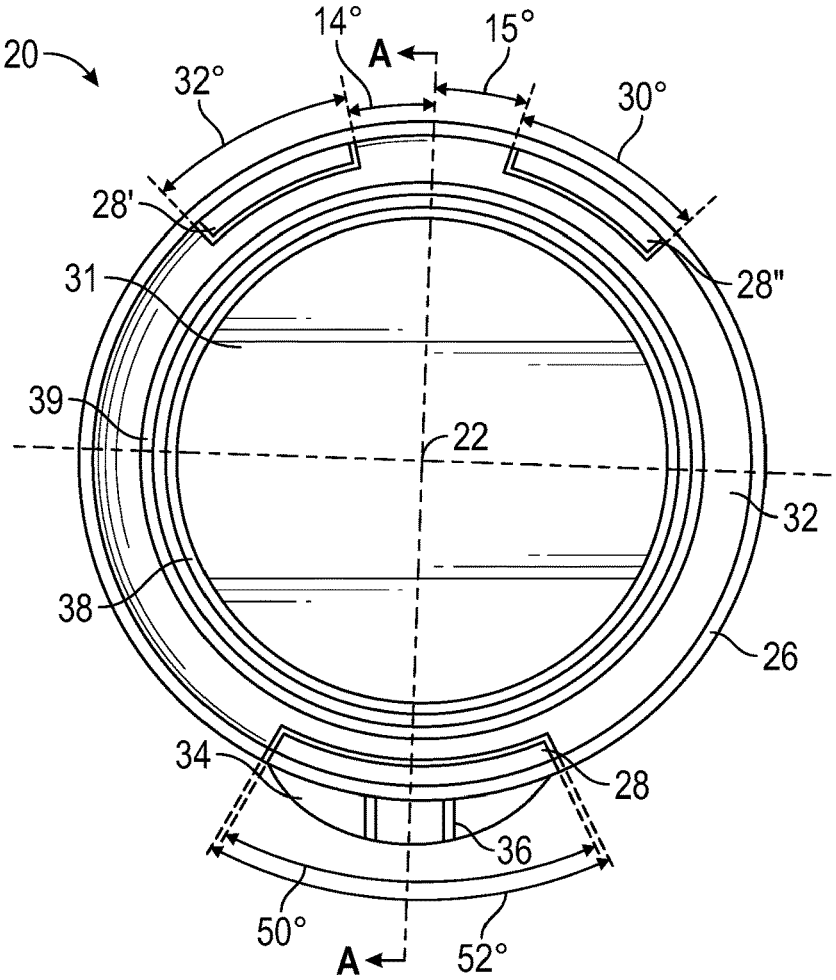
FIG. 5 is bottom plan view of the underside of a security cap of an apparatus according to the present disclosure.
Figure 5A:
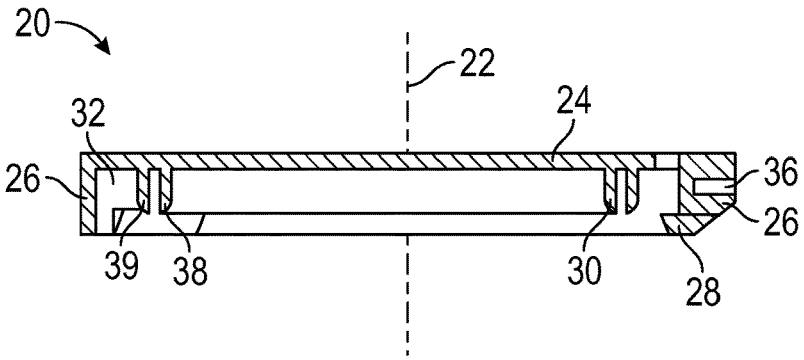
FIG. 5A is a vertical side sectional view of the cap, taken along section line A-A in FIG. 5.

In the following disclosure and claims, "up," "upward," "down," and "downward," are used in conventional manners. "Up" and "down" and similar directional words thus can be presumed to be in relation to the direction of gravity. In FIGS. 1-4 and 5A, for example, "up" (and "ascending"), and "down" (and "descending"), refer to directions toward the top and toward the bottom, respectively, of the drawing figures. "Inward" and "outward" refer to radial directions toward or away from a central axis (e.g., as depicted in FIG. 5); in this description and in many of the drawing figures, the central axis is presumed to be vertically oriented. A container secured by the apparatus, for example, may be assumed, for purposes of this disclosure, to be situated in space with its longitudinal axis oriented vertically, for example as it is when the container is resting upon a horizontal surface—despite that when in use, the container may be oriented in any position within three-dimensional space.

A cap according to the present disclosure is contemplated for use especially upon conventional beverage cans, such as the cans commonly used to contain carbonated drinks, beers and lagers, etc. However, the invention is not necessarily so limited, and can be adapted for use with any container having a top perimeter or circumferential rim that extends a small distance (e.g., about 0.039 inches to 0.19 inches (approximately 1 mm to approximately 3 mm) laterally/radially outward from its juncture with the wall of the can body.

Initial attention is invited to FIGS. 1-7. The system and apparatus according to the present disclosure include a cap 20 and a separate yet complementary opener 60. The cap 20 is devised and configured for secure installation upon the top of a can or container 75 (FIG. 7) to be secured. After installation atop a container 75, the cap 20 can be disengaged and removed there-from only with significant difficulty and effort, unless the appropriate complementary opener 60 (FIG. 6) is used. The opener 60 is useable to disengage and remove the cap 20 with comparative ease. Thus, only a user having possession of the an opener 60 properly corresponding to the cap 20 can readily and easily detach the cap from the container 75 to permit subsequently conventional access to the container contents. By regulating the accessibility of the opener 60, access to the contents of a container can be selectively limited and controlled.

The cap 20 can be installed upon the top of a container 75 at the time the container is fabricated and filled (e.g., at the beverage canning plant), using any suitable means. It is contemplated, however, and included in the scope of the present means and method, that the security cap may be initially installed upon a container by using the opener tool 60. The cap 20 can be removed from the container 75 by using the opener 60, and if desired, the cap may be re-installed upon the container (e.g., after the container has been opened and its contents partially consumed) using the same opener. Thus, the cap 20 may be either reused several times, or may be considered disposable for use a single time.

Figure 7:
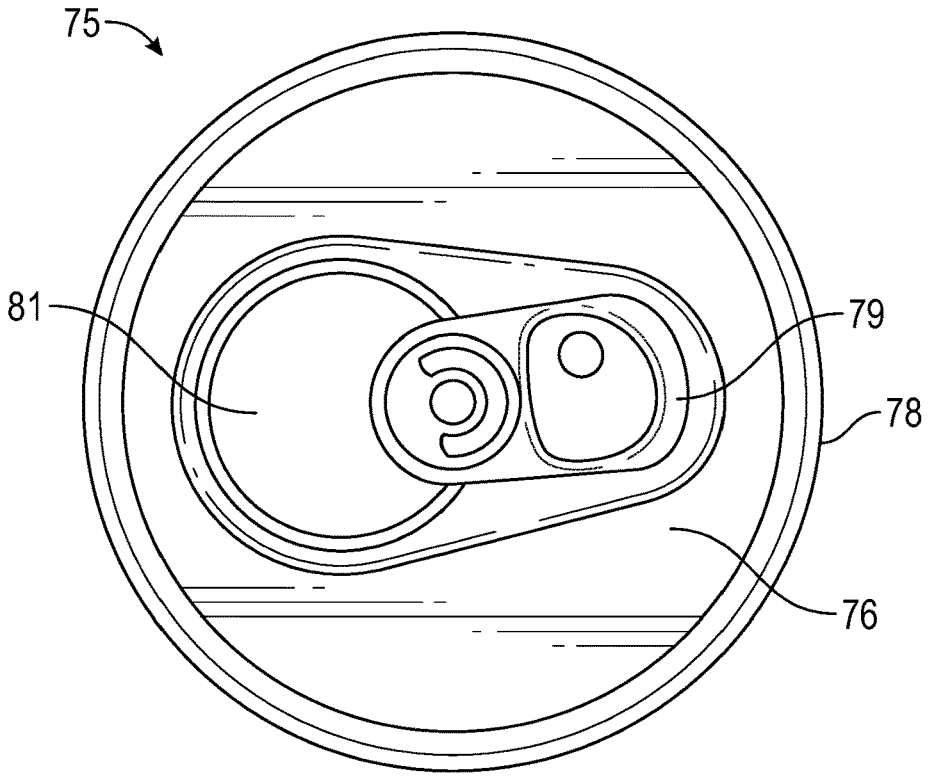
FIG. 7 is a top plan view of a prior art container having a circumferential rim.

The system and apparatus of the present invention thus permit the top of a container to be secured against unauthorized opening. FIG. 7 depicts the top of a container 75 upon which a cap 20 may be installed. The container 75 may be, by way of a typical example, an aluminum or aluminum alloy beverage can. Such beverage cans are devised to hold a fixed portion of liquid such as carbonated soft drinks, alcoholic beverages, fruit juices, teas, herbal teas, energy drinks, etc. Such beverage cans usually are made of aluminum or sometimes from tin-plated steel with an aluminum top lid 76. The container 75 has a top lid 76 encircled on its outer perimeter or circumference by a raised rim 78, as known in the beverage can fabrication art. Such cans are filled with a beverage (or other contents) before the top lid 76 is crimped on. During container filling and completion operations known in the art, a filling head centers the can body using gas pressure, purges the air from the body interior, and fills the body with the beverage. The top lid 76 (usually with an opening mechanism built-in) is placed on the can, and then crimped in two operations. First a mechanical seaming head engages the top lid 76 from above, while a seaming roller to the side curls the edge of the top lid around the edge of the open can body. The head and roller spin the can 75 in a complete circle to seal the container all the way around the perimeter of the top. A pressure roller with a different profile then drives together the two edges (of the lid 76 and the wall of the can body) under pressure to create a gas-tight seal defined at the raised bead or perimetric rim 78. In this disclosure and the claims, "perimetric rim" particularly refers to a circular or ellipsoid circumferential rim, but also includes a rim that is not circular or oval in shape, put yet has a perimeter, such as a rim whose perimeter defines in plan view a square or some other polygon.

The present system is useable therefore upon the top of any container featuring a raised rim 78 that bulges or extends slightly (e.g., approximately 1 mm) outward from the top lid 76. Further, the present system can be fabricated to be attachable atop such a container of practically any size or volume. It is contemplated that the present system and method finds particular use upon cylindrical (circular or oval section) containers with round or oval tops, and most especially upon cylindrical containers with round tops. The invention is not strictly so limited, however, and may be adapted for use on containers having other lateral cross-sectional shapes, such as spheres and prisms. The system is well-suited for use on the standard beverage can commonly encountered in North America, which holds twelve U.S. fluid ounces (355 ml). Such a U.S. standard can is about 4.83 inches (122.7 mm) high, about 2.13 inches (54.1 mm) in diameter at the top lid, and about 2.60 inches (66.0 mm) in diameter at the widest point of the can body. Nevertheless, the present security system can be manufactured in sizes and configurations adapted for use on other sizes/volumes of containers, such as the smaller 250 ml beverage cans, or cans of volumes 330 ml, 350 ml, or 375 ml, or other volumes and diameters, in common use around the world. By way of further example, larger cans having a volume of 680 ml, and a rim diameter of about 64 mm, are often used to contain fruit drinks in the USA.

As seen in FIG. 7, the container 75 upon which use of the present system is contemplated to have a stay-on tab or "stay tab" 79, as known in the art, for permitting a user manually to sever and bend an opening cover 81 to permit access to the container interior. The stay-tab 79 type of can opening mechanism is known and current in the art, but the system according to the present disclosure is useable also with a previously popular can having a now-disfavored fully detachable "pull tab," or somewhat hazardous "push tab," manual opener, mostly obsolete throughout the world. Moreover, the system according to the present disclosure finds utility in use upon cans with "wide mouth" or "full aperture end" opening mechanisms. In all versions of container lids, the present system is particularly devised to prevent unauthorized access to the stay-tab 79 or other built-in opening mechanism, thereby preventing the opening of the cover 81 provided in the container's top lid 76. Alternatively, it is noted that a cap 20 installed according to the present system also prevents the use of an ordinary electric can opener, and prevents the use of conventional manual can openers used to puncture the container lid 26 (both such known types of openers typically necessitating operative engagement with the container rim 78).

Combined reference is made again to FIGS. 1-5A, illustrating the cap 20 portion of the system. The cap 20 preferably is composed of a thermoplastic polymer, most preferably an injection-molded acrylonitrile butadiene styrene (ABS). ABS is a desirable composition for the cap 20 as while it is generally firm and durable, it affords a degree of bendable resiliency well-suited for the function of the present system. The cap 20 is fabricated to size and shape according to the diameter/dimensions of the top of the container to which it is removably secured, as apparent from further disclosure herein. The cap 20 preferably but not necessarily is molded integrally as a unit component.

Figure 2:
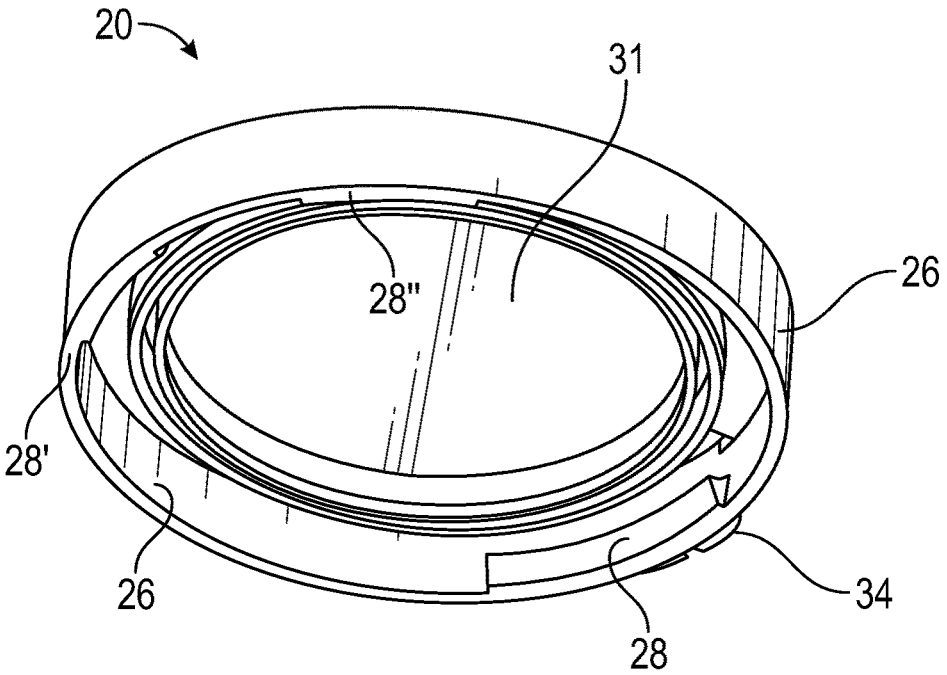
FIG. 2 is a bottom perspective view of a security cap of an apparatus according to the present disclosure.
Figure 3:
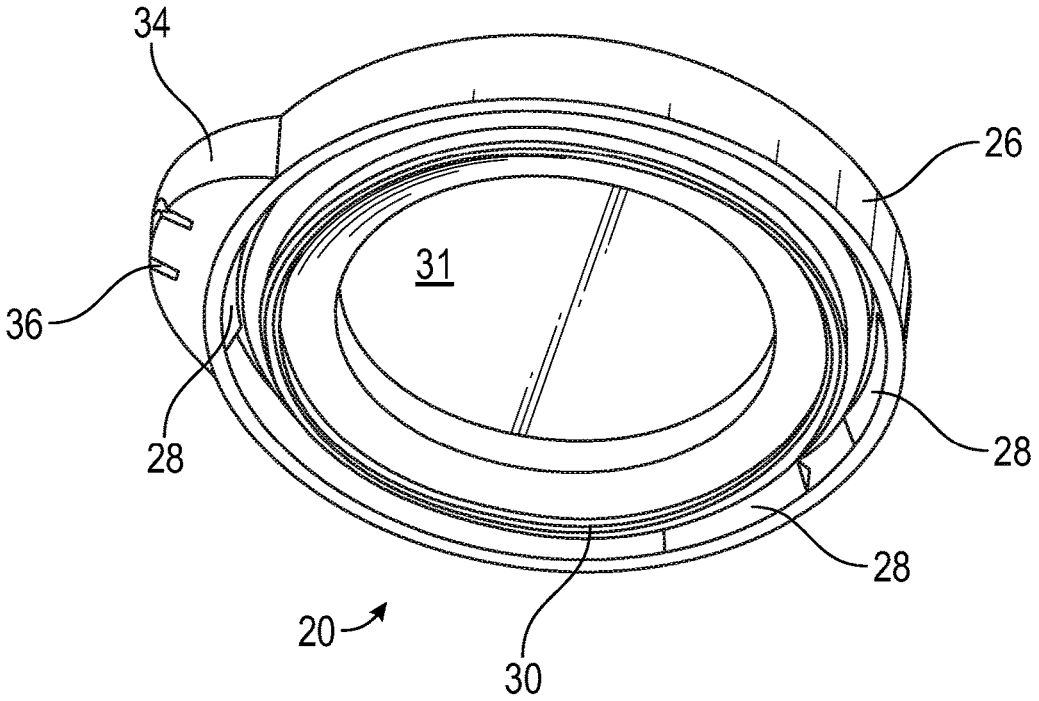
FIG. 3 is another bottom perspective view, showing the underside of a security cap according to the system of the present disclosure.
Figure 4:
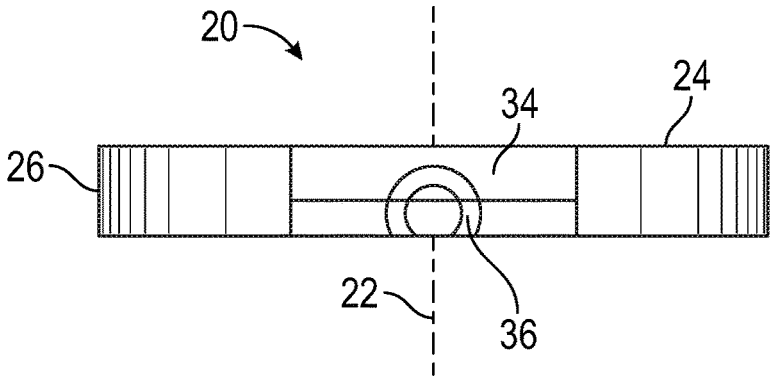
FIG. 4 is front view of the cap.
Figure 8:
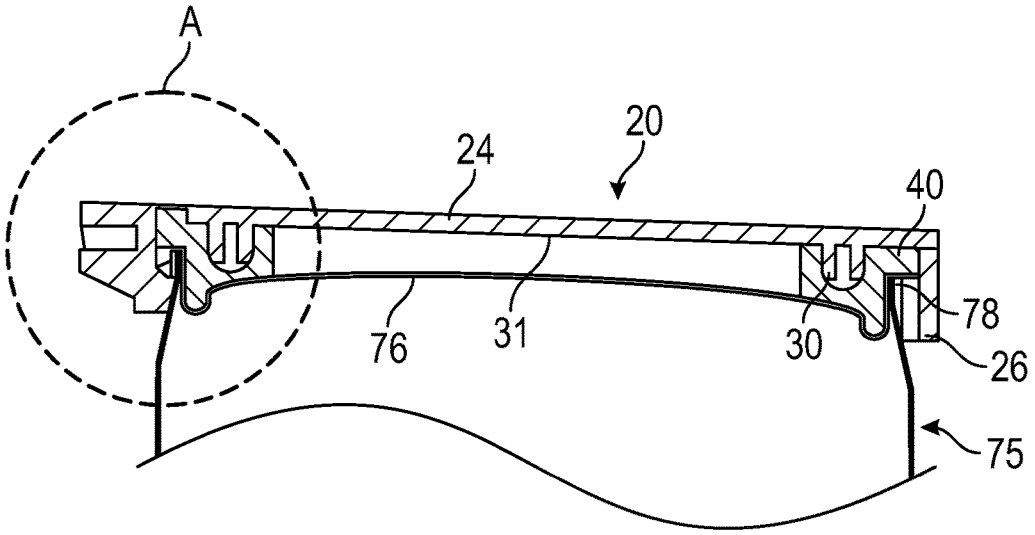
FIG. 8 is a side sectional view of a security cap according to the present disclosure, installed upon the top of a container, such as the container of FIG. 7.
Figure 8A:
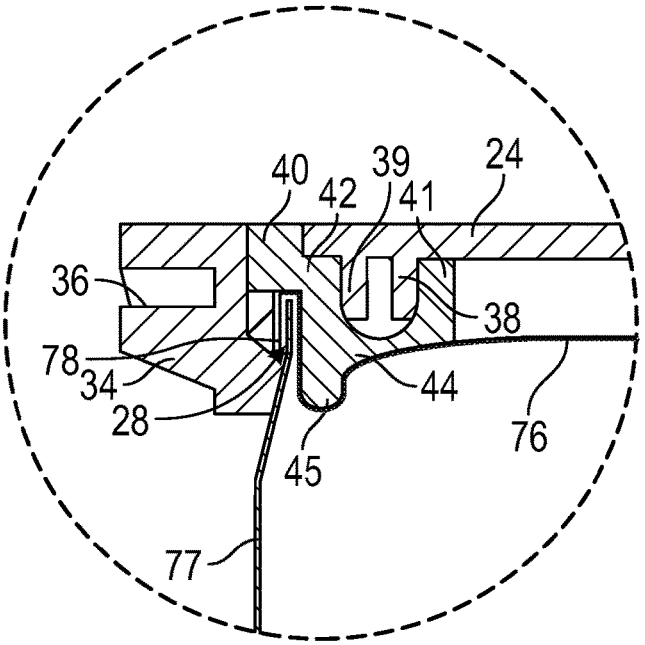
FIG. 8A is an enlarged side sectional view of the portion "A" of the a cap as illustrated in FIG. 8.
Figure 9:
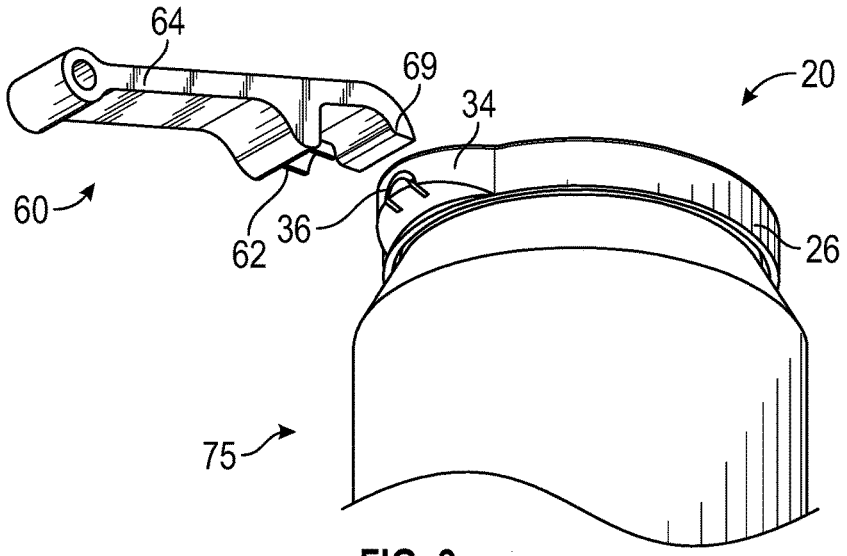
FIG. 9 is a side perspective view, from below, illustrating a cap according to the present system installed upon a container, and an opener according to the present system poised for use.

The cap 20 optionally is provided with a gasket 40 (FIGS. 8, 8A). FIGS. 2 and 3 show a cap 20 without any gasket mounted therein (but depicting the flange 30 optionally used to mount a gasket). In a first application of the present system, the cap 20 functions simply for basic security, e.g., a child-proof cap. In such a usage, a gasket 40 need not necessarily be installed on the cap, between the cap's lid 24 and the top of the container. In this instance, the cap 20 is simply installed and removed without a gasket. In a second type of application, the system may be used on a container for non-carbonated beverages. This embodiment has the gasket 40 mounted therein (as described further herein), and the cap 20 serves as a re-sealable security (e.g., childproof) cover for the container, that limits or prevents leakage from an opened container. Another potential application is with a container of carbonated beverage. In such an advantageous use of the system, a gasket 40 is mounted in the cap 20, and serves as a re-sealable security cover that also prevents or reduces the rate at which the carbonation escapes an opened can.

Cap 20 ordinarily, but not strictly necessarily, has a generally cylindrical shape, e.g., for use upon a cylindrical (circular or ellipsoid) container. The cap's shape/size is adapted to complement to the shape/size of the top of the particular container upon which it will be used. The cap thus may be adapted in size/shape for use on containers of other shapes (e.g., right rectangular prisms, right triangular prisms). The cap 20 has a central imaginary axis 22 (FIGS. 4 and 5) which is the longitudinal axis of the general cylinder (circular, or optionally mildly elliptical) of the cap's overall shape. (For a container defining a right prism, the imaginary axis typically corresponds generally to the container's longitudinal axis of symmetry.) In a preferred embodiment, the cap 20 has a round, generally planar or disk-like lid 24, and an exterior (e.g., generally cylindrical) wall 26 that is substantially coaxial with the central axis 22, and which descends from the periphery or peripheral portion of the lid 24. The exterior wall 26 preferably is molded integrally with the lid 24 and is mildly bendable in relation thereto.

Each cap 20 has at least one hooked catch 28 extending upwardly from the exterior wall 26 and inwardly toward the central axis 22. In a preferred embodiment, the catches 28 are three in number. Referring particularly to FIGS. 2, 3, 5 and 5A, the one or more hooked catches 28 is/are integrally molded with the exterior wall 26, and preferably extends upward from or near the bottom edge of the exterior wall 26. The exterior wall 26 is resiliently bendable to displace at least one catch 28 radially outward from the central axis 22. More specifically, operation of the opener 60 when engaged with the cap 20 serves to pull the exterior wall 26 away from the secured container, thereby to disengage a catch 28 from the perimetric rim 78 of the container 75. As mentioned, the at least one hooked catch 28 preferably is a plurality of hooked catches (e.g., catches 28, 28' and 28" in FIG. 5). The plurality of hooked catches 28 most preferably number three catches, spaced around the overall circumference of the exterior wall 26. Preferably, a first hooked catch 28 is located in circumferential alignment with a swell 34 on the cap 20, as described further herein.

FIG. 5 offers additional disclosure of the preferred arrangement of the hooked catches 28. An imaginary vertical section plane A-A bisects symmetrically the cap 20. A first and necessary hooked catch 28 is aligned in substantial circumferential registration with the swell 34 on the cap; the key slot 36 preferably is also symmetrically aligned within the swell, so the swell 34 and its internal key slot 36 symmetrically span the section plane A-A. The swell 34 may subtend an arc of approximately 50° on the periphery of the cap 20. As indicated by FIG. 5, the first hooked catch 28 preferably is symmetrically aligned with the swell, and preferably but not necessarily subtends an angle of approximately 52° on the inside of the exterior wall 26. As also illustrated by FIG. 5, a second hooked catch 28' subtends an arc of, for example, about 32°, and is offset circumferentially approximately 14° to about 15° (i.e. counterclockwise in FIG. 5) from the section plane A-A. A third hooked catch 28" subtends an arc of approximately 30°, and is offset approximately 14° to about 15° (i.e. clockwise in FIG. 5) from the section plane A-A. The foregoing angular dimensions are offered by way of example, and not by critical limitation. It has been determined that such a circumferential or perimetric arrangement of three catches 28, 28', 28' on the inside of the exterior wall 26 maximizes the secure installation of the cap 20, while also facilitating the facile release of the cap from the container top, using the opener 60, with acceptable manual effort by the user.

The cap 20 preferably is installed, initially or repeatedly, upon a container 75, by engaging at least one hooked catch 28 with an underside of the perimetric rim 78 of a container (see, e.g., FIGS. 7, 8, and 8A), by resiliently bending the exterior wall 26 to displace at least one of the catches 28 radially outward from the central axis 22, placing the cap atop the container in registration therewith, and then permitting the exterior wall to rebound radially inward to hook the at least on catch 28 beneath the perimetric rim.

As mentioned, the cap 20 preferably, but optionally, is provided with a gasket 40. A (cylindrical) gasket mounting flange 30, substantially coaxial with the central axis 22, descends from the bottom surface 31 of the lid 24 to define a gasket space 32 between the mounting flange 30 and the exterior wall 26 (see, e.g., FIG. 5A). The gasket space 32 thus is a somewhat annular void into which a portion of a sealing gasket 40 can be inserted.

A swell 34 is formed integrally which protrudes outwardly from the exterior wall 26. As illustrated in, for example, FIGS. 3 and 5, the swell 34 preferably is aligned circumferentially with a first one of the catches 28. The swell 34 has defined therein a key slot 36 into which a key is insertable, as shall be further described herein. The swell thus supplies bulk for the molded provision therein of a key slot 36 of sufficient size and extent (in two or three dimensions) to permit operation of the system as described herein. The swell 34 also provides desirable structural strength to the cap 20 during the leveraged removal and/or re-installation of the cap on/from the container's top. The key slot 36 preferably, but not necessarily, defines a three-dimensional shape and extends radially outwardly within the swell, as illustrated in FIGS. 1, 3, 5, 8 and 9. The key slot 36 preferably is arcuate in shape, but is not necessarily so limited; other shapes and configurations for the slot 36 are conceivable and suitable without departing from the scope and spirit of the invention, provided an opener 60 with a complementarily-shaped and sized key 62 (FIG. 6) also is provided. An acute shape of the key slot 36 preferably defines a semicircle when viewed laterally (i.e., radially), as suggested by FIGS. 4 and 9.

FIGS. 5, 5A, 8 and 8A show a preferred embodiment of the cap 20 in which the gasket mounting flange 30 is comprised of a concentric pair of (e.g. cylindrical) flange walls, an inner flange wall 38 and an outer flange wall 39 separated by an annular space. The flange walls 38, 39, depend down from the underside 31 of the lid 24, and are mildly flexible so to be resiliently bendable radially in relation to each other, independently of one another. This resilient bendability permits the mounting flange 30 better to mount securely the gasket 40 thereon; the resiliency of the two flange walls 38, 39, to bend radially inward and outward, allow the gasket to be easily mounted on, and easily removed (as needed), from the mounting flange 30. Moreover and alternatively, a single-walled relatively thicker flange 30 may also serve to mount the gasket 40. However, providing a single-walled flange may result in an ugly "sink mark" on the top surface of the lid 24. With injection molding, it is best to maintain a consistent wall thickness wherever possible, and splitting a single thick support flange 30 into two thinner walls 38, 39 reduces or eliminates the potential for unsightly sink marks on the visible upper surface of the cap's lid 24.

As best seen with combined reference to FIGS. 8 and 8A, the gasket mounting flange 30 preferably but optionally mounts a sealing gasket gasket 40. The gasket 40 provides a sealing function to help keep the liquid (and gaseous) contents of a container 75 within the container in the event the cap 20 is removed from, and then replaced upon, the container after it has been opened. The gasket 40 is situated upon the gasket mounting flange 30. The gasket 40 has an inside wall 41 adjacent an inside face of the mounting flange 30 and an outside wall 42 disposed within the gasket space 32 (FIG. 5A) and preferably also in contact with the exterior wall 26. The gasket 40 also has a bottom sealing portion or surface 44 contactable with the top 76 of a container 75 to be secured. The bottom sealing surface 44 preferably features a circumferential bead 45 that is insertible into a circular channel defined in the container top. In a preferred embodiment, the gasket 40 is molded, as a single component, from silicone rubber—most preferably but optionally a silicone rubber having a durometer hardness of between Shore 10 A and Shore 20 A.

The cross-sections of FIGS. 8 and 8A thus depict an installation of the security system's cap 20 upon the container such as a beverage can 75. The at least one hooked catch 28 extends upwardly from the exterior wall 26 and inwardly toward the cap's central axis. The optional cylindrical gasket mounting flange 30, coaxial with the central axis, descends from the bottom surface 31 of the lid to define the gasket space (i.e., space 32 in FIG. 5A) between the mounting flange and the exterior wall 26. The gasket 40 is upon the gasket mounting flange 30 with the gasket inside wall 41 adjacent, preferably contacting against, an inside face of the inner flange wall 38. The outside gasket wall 42 is situated within the gasket space, and preferably is in snug contact with the exterior face of the outside flange wall 39. A bottom sealing surface 44 contacts the top 76 of the container 75. Many beverage cans and other containers have a circular channel defined in the container top 76 just inside the circumferential or perimetric rim 78. When a gasket 40 is used, a convex circumferential bead 45 preferably is defined on the sealing surface 44 for sealing insertion into the circular channel defined in the container top 76.

FIG. 8A also offers detailed illustration of a first hooked catch 28 engaged against the underside of the container's perimetric rim 78, at the top of the container body wall 77 where the container top 76 and wall come together. Other hooked catches 28 likewise engage the rim 78 when the cap 20 is in secured installation upon the container.

The apparatus and system according to this disclosure also feature the opener 60. Attention is invited to FIGS. 6 and 9. The opener 60 is a tool molded from, for example, ABS plastic and in the preferred embodiment is adapted to be grasped in a user's hand. The opener preferably is molded as a one-piece unit. The opener 60 is operatively engagable with the swell 34 on the cap 20. The opener has a key portion 62 insertible into the key slot 36 of the swell 34 on the cap 20. Proper engagement of the opener 60 with the cap 20, and manual manipulation of the opener as described hereinafter, detaches the cap from the top of a secured container 75.

Figure 6:
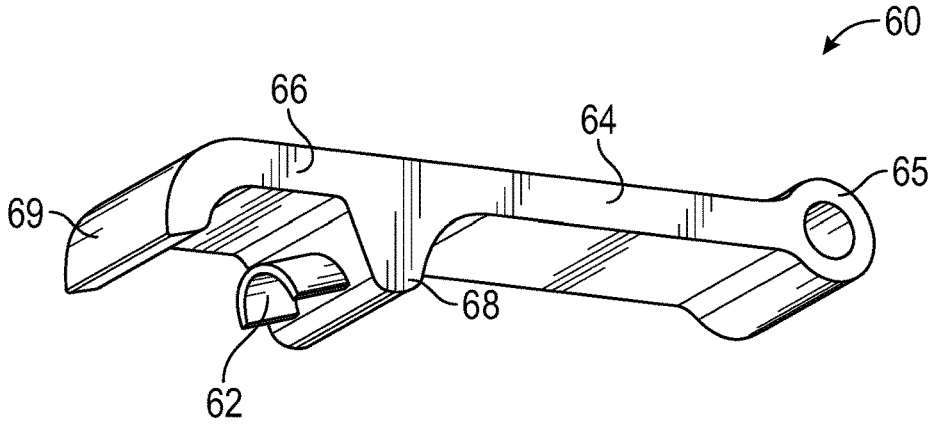
FIG. 6 is a side perspective view of an opener tool of an apparatus according to the present disclosure.

Referring particularly to FIG. 6, the opener 60 has a body or handle 64 having a first end 65 and a second end 66. A key flange 68 extends from an underside of the handle 64 between the first end 65 and the second end 66. There also is provided a fulcrum flange 69 on the underside of the handle 64 at the second end 66. The fulcrum flange 69 may extend down in a short curved arc, as seen in FIG. 6. The opener key 62 extends from the key flange 68 and toward the second end 66.

Figure 11:
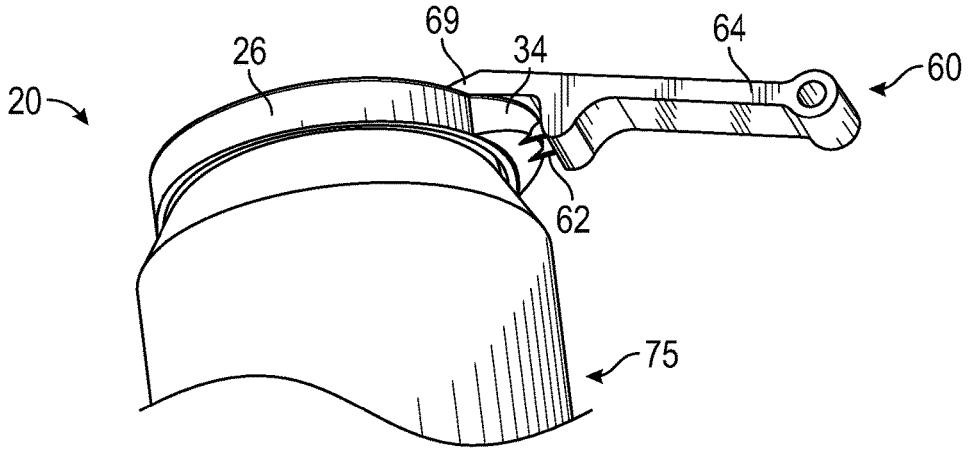
FIG. 11 is another side perspective view, from below, illustrating a cap according to the present system installed upon a container, and an opener according to the present system engaged with the cap and positioned for use to remove the cap from the container.
Figure 12:
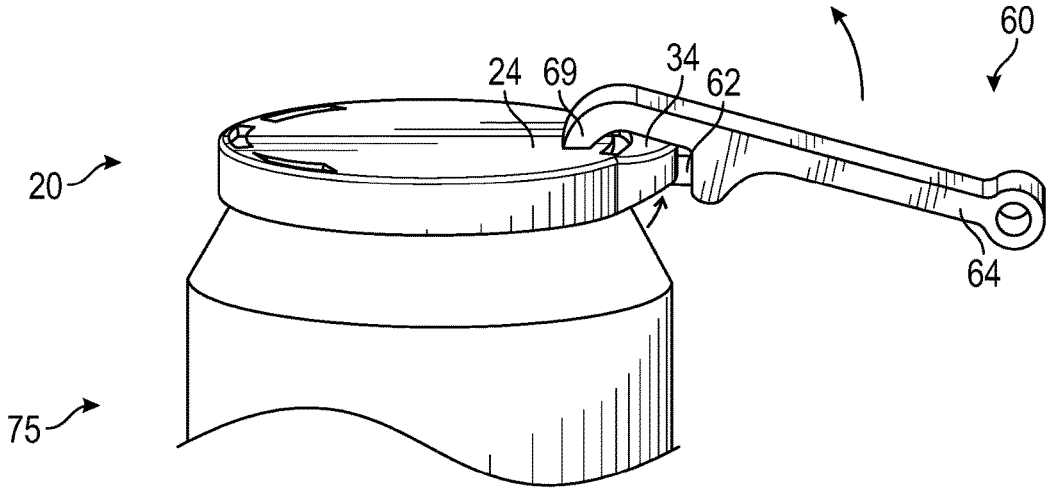
FIG. 12 is a side perspective view illustrating a cap according to the present system installed upon a container, and an opener according to the present system engaged with the cap and positioned for use to remove the cap from the container.

Referring collectively to FIGS. 1, 3-5, and 9, it is seen that the recess of the key slot 36 preferably defines a generally arcuate shape, and that the slot 36 extends radially outwardly within the swell 34. The arc of the key slot 36 may be from about 100° to about 200° and preferably subtends approximately a semicircle (180°) in its extent. The solid key 62 on the handle 64 (FIG. 6) defines an arcuate shape complementary to the arcuate shape of the key slot 36, such that the key 62 is slidably engagable into or with the key slot 36, as indicated in FIGS. 11 and 12. The solid key 62 has an arcuate extent no greater than, and optionally somewhat less than, the corresponding angular extent of the slot 36.

Figure 10:
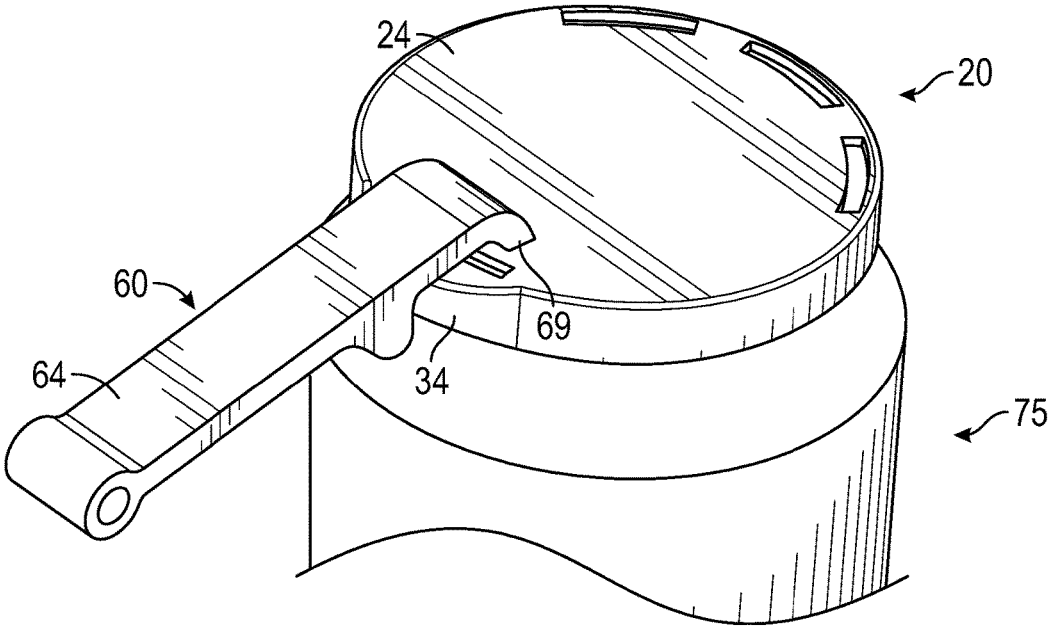
FIG. 10 is a side perspective view, from above, illustrating a cap according to the present system installed upon a container, and an opener according to the present system poised for use.

FIGS. 9-12 illustrate the use of the system to remove the cap 20 from a container 75. The cap 20 has been installed previously upon the top of the container 75 as described herein, particularly by engaging the at least one catches 28 with the undersurface of the rim 78 of the container. The user grasps the handle 64 of the opener 60. The opener 60 thus is taken in the hand of the user and is brought into the vicinity of the swell 34 on the exterior wall 26 of the cap 20, as suggested in FIGS. 9 and 10. The opener's key 62 is aligned with the key slot 36 in the swell 34, while the opener's fulcrum flange 69 is moved toward the top of the swell. As indicated by FIGS. 10-12, the opener key 62 is inserted into the key slot 36, and the distal end of the fulcrum flange 69 is placed against the top surface of the cap's lid 24. With the key 62 snugly within the key slot 36, and the fulcrum flange contacting the upper surface of the lid 24, the opener 60 is in position (see especially FIG. 11) for use to disengage and remove the cap 20 from the top of the container 75.

The user then lifts upward upon the handle 64 of the opener 60, as indicated by the large directional arrow in FIG. 12, while maintaining the key 62 within the key slot 36, and the end of the fulcrum flange 69 against the lid of the cap 20. The lifting of the handle 64 by the user transmits a lifting force from the key 62 to the swell 34, while the fulcrum flange 69 simultaneously pushes against the lid 24. The opener 60 thus functions as a class two lever, with the load being situated at the key 62, and the lever fulcrum at the end of the fulcrum flange 69. The lever's load arm extends between the fulcrum flange 69 and the key 62, while the lever's effort arm extends from the fulcrum flange to the handle 64 where the user is applying the lifting force.

The upward effort applied to the handle 64 by the user is transferred through the opener 60 to the bottom of the swell 34 via the key and key slot engagement, with the result that the outer portion of the swell is lifted upward relative to the container 75, as suggested by the small directional arrow of FIG. 12. (During the flexing of the exterior wall 26 under the lever action of the opener 60, the lid 24 of the cap 20 remains mostly fixed in position upon the container 75.) Because the swell 34 is integrated with the cap's exterior wall 26, the upward movement of the swell 34 bends the exterior wall 26 in the vicinity of the swell. More specifically, the exterior wall 26, adjacent to the swell 34, bends radially outward away from the cap's central axis 22. The lower edge of the exterior wall 26 bendably moves the farthest, while the top of the exterior wall bends slightly if at all, as it is connected to the lid 24 portion of the cap 20. As the bottom portion of the exterior wall 26 (nearby the swell being acted upon by the opener 60) bends outward (small directional arrow of FIG. 12), the first hook catch 28 (e.g., FIG. 5) that is located beneath the key slot 36 is drawn out from under the container's perimetric rim 78 and thus is disengaged from it. This frees that portion of the cap 20 which is in the area of the swell 34 to continue moving up under the action of the rising handle 64 of the opener 60. The user continues lifting upon the handle 64 of the opener 60 with the result that a generous portion of the exterior wall 26 is pulled away from the rim 78 of the container 75, moving the hooked catch 28 out away from the rim 78. After the first hooked catch 28 is disconnected from the container rim 78, the cap 20 can bend and shift slightly due to the now-increased distance between the first catch 28' and each of the other catches on the exterior wall 26.

As the user continues to lift the handle of the opener 60, the cap's lid 24 bends slightly, and the entire cap 20 is detached from the top of the container 75 as other hook catches 28' and 28" in turn disengage from beneath the container rim 78. A completed pivoting of the opener 60 about its fulcrum flange 69 thus pops the cap 20 from its secure installation upon the top of the container 75. The cap 20 can be removed manually, thereby exposing the tab 79 and opening cover 81 for ordinary use according to convention.

If desired, the cap 20 can be re-installed upon the container 75. The opener 60 is used, and the removal process is essentially reversed to replace the cap 20 upon the opened container top. The cap 20 is simply placed upon the top of the container with one of two of the hooked catches (e.g., catches 28' and 28") hooked under the rim 78, and the opener 60 is used to bend the cap 20 to re-engage the first catch 28 beneath the rim.

A method according to the present disclosure is apparent from the foregoing, but will be recapitulated here to promote additional understanding. Accordingly there has been disclosed a method for securing a container 75 having a top 76 and a perimetric rim 78. The method includes the steps of providing a cap 20 having a central axis 22 and, optionally, a gasket mounting flange 30, optionally but preferably disposing a gasket 40 upon the gasket mounting flange, the gasket having a bottom sealing surface 44, and then optionally contacting the top 76 of the container with the bottom sealing surface 44. Providing a cap 20 includes providing: a round lid 24; a (e.g., cylindrical) exterior wall 26 coaxial with the central axis 22 and descending from a periphery of the lid 24; at least one hooked catch 28 extending upwardly from the exterior wall and inwardly toward the central axis 22; the gasket mounting flange 30, coaxial with the central axis and descending from a bottom surface 31 of the lid to define a gasket space 32 between the mounting flange and the exterior wall; and a swell 34, aligned circumferentially with the at least one catch, the swell protruding outwardly from the exterior wall, and defining therein a key slot 36 into which a key 62 is insertible.

The preferable but optional step of disposing the gasket 40 upon the gasket mounting flange includes disposing a gasket comprising: an inside wall 41 adjacent an inside face of the mounting flange; an outside wall situated within the gasket space 32 and in contact with the exterior wall 26; and the bottom sealing surface 44. The preferred method further includes the step of defining the key slot 36 to have an arcuate shape extending radially outwardly within the swell 34. Defining the key slot optionally also includes the step of defining the key slot to have a shape of a semicircle. The step of contacting the top 76 of the container 75 with the bottom sealing surface 44 of the gasket preferably but optionally includes inserting a circumferential bead 45 on the gasket's sealing surface into a circular channel defined in the container top 76. The method thus broadly involves installing the cap 20 upon the top of a container, regardless whether the cap has a gasket mounting flange 30, and notwithstanding that there may not be a mounting of a gasket 40 upon any such flange 30 that may be in the cap.

The method includes the step of engaging the at least one hooked catch 28 with an underside of the perimetric rim 78 of a container. This method further features the step of integrally molding the at least one hooked catch 28 with the cap's exterior wall 26, wherein engaging the at least one hooked catch with an underside of the perimetric rim 78 includes resiliently bending the exterior wall 26 to displace the at least one catch radially outward from the central axis 22, and permitting the exterior wall to rebound radially inward to hook the catch 28 beneath the circumferential or perimetric rim. These latter steps reliably install the cap upon the top portion of the container 75 to secure it against unauthorized opening. In this method, the step of integrally molding the at least one hooked catch 28 comprises molding a plurality of hooked catches 28, 28', and 28', with a first one 28 of the hooked catches being aligned with the swell 34. Molding a plurality of hooked catches 28, 28', 28" may include the step of molding three catches and spacing the three catches around a circumference of the exterior wall 26. If the method includes the optional step of mounting a gasket on the cap, the method includes the beneficial step of sealing the top 76 of the container (e.g., a previously opened container) with the gasket 40. Sealing the container with the gasket prevents, or at least reduces, the unwanted escape of liquids (beverage) or gasses (e.g., carbonation $CO_2$) from the container's interior.

The overall method very preferably also includes the steps of providing an opener 60 and removing the cap 20 from the container 75, wherein removing the cap means operatively engaging the opener 60 with the swell 34 by inserting the key 62 of the opener into the key slot 36 in the cap 20. The step of providing an opener includes: providing a handle 64 having a first end 65 and a second end 66; supplying a key flange 68 on an underside of the handle between the first end and the second end; supplying an arcuate fulcrum flange 69 on the underside of the handle at the second end 66; and extending the key 62 from the key flange and toward the second end 66.

A cap 20 securely installed upon the top of a container 75 is removed there from by means of the disclosed system. As explained, the method of removing the cap from the container includes, while the key 62 is maintained within the key slot 36, the additional steps of: (a) contacting the fulcrum flange 69 against the lid 24; (b) lifting the handle 64, thereby pushing the key 62 upward against the swell 34; (c) levering with the opener 60 to bend the exterior wall 26 to displace the first one of the hooked catches 28 radially outward from the lid's central axis 22, thereby disengaging the first one 28 of the catches from the underside of the container's perimetric rim 78; (d) lifting the cap 20 from the top of the container 75; (e) disengaging others of the hooked catches 28', 28" from the underside of the perimetric rim; and (e) lifting the cap 20 from the top of the container. In one preferred method, the step of defining a key slot 36 means defining a key slot having an arcuate shape and which extends radially outwardly within the cap's swell 34, while the step of inserting a key means sliding into the key slot 36 a key 62 having an arcuate shape complementary to the arcuate shape of the key slot.

It is seen, therefore, that a system and method are provided for installing a security cap on a container, such as an aluminum beverage can, to limit the persons who can access the container's contents. A cap is installed atop the container, for example shortly after the time the container is filled, or perhaps prior to distribution and/or sale. An opener is provided with a key that is complementary to a key slot in the cap, so that the proper opener with the appropriate key is needed to remove the cap from the container. Access to the interior of the container by unauthorized or unqualified persons, such as minors or unlicensed personnel, thereby is regulated or prevented. Access to the interior of containers 75 fitted with the removable cap 20 system is limited to those persons having access to the opener 60 having a correspondingly shaped and sized key 62.

Although the invention has been described in detail with particular reference to these preferred embodiments, other embodiments can achieve the same results. In the previous description, specific details are set forth, such as specific materials, structures, dimensions, etc., in order to provide a thorough understanding of the present invention. However, as one having ordinary skill in the art would recognize, the present invention can be practiced without resorting to the details specifically set forth.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover in the appended claims all such modifications and equivalents.

What is claimed is:

1. A security covering system for a container having a top with a perimetric rim, the system comprising:

a cap having a central axis and further comprising:

a lid;

an exterior wall coaxial with the central axis and descending from a periphery of the lid;

at least one hooked catch extending upwardly from the exterior wall and inwardly toward the central axis;

a swell formed integrally with and protruding outwardly from the exterior wall, aligned circumferentially with the at least one catch, and defining therein a key slot into which a key is insertable, wherein the key slot defines a recess having a nonrectilinear vertical cross-sectional shape extending radially outward through the swell.

2. The system according to claim 1, further comprising:

a gasket mounting flange, coaxial with the central axis, descending from a bottom surface of the lid to define a gasket space between the mounting flange and the exterior wall; and a gasket situated upon the gasket mounting flange, the gasket comprising:

an inside wall adjacent an inside face of the mounting flange;

an outside wall disposed within the gasket space and in contact with the exterior wall; and a bottom sealing surface contactable with a container top.

3. The system according to claim 1 wherein the the vertical cross-sectional shape is an arcuate shape.

4. The system according to claim 3 wherein the arcuate shape defines a semicircle.

5. The system according to claim 2 wherein the bottom sealing surface comprises a circumferential bead insertable into a circular channel defined in the container top.

6. The system according to claim 2 wherein the gasket comprises silicone rubber with a durometer of between Shore 10 A and Shore 20 A.

7. The system according to claim 1 further comprising an opener, operatively engagable with the swell, and comprising a key insertable into the key slot, the key defining a shape complementary to the vertical cross-sectional shape of the key slot recess.

8. The system according to claim 7 wherein the opener further comprises:

a handle having a first end and a second end;

a key flange on an underside of the handle between the first end and the second end; and a fulcrum flange on the underside of the handle at the second end;

wherein the key extends toward the second end and from the key flange.

9. The system according to claim 8 wherein:

the key comprises a key having an arcuate shape complementary to the arcuate shape of the key slot recess, wherein the key is slidably engagable with the key slot.

10. The system according to claim 1 wherein the at least one hooked catch is integrally molded with the exterior wall, and the exterior wall is resiliently bendable to displace the at least one catch radially outward from the central axis.

11. The system according to claim 10 wherein the at least one hooked catch comprises a plurality of hooked catches.

12. The system according to claim 11 wherein the plurality of hooked catches comprises three catches spaced around a circumference of the exterior wall.

13. A method for providing security against unauthorized opening of a container having a top with a perimetric rim, the method comprising:

providing a cap having a central axis and comprising:

a lid;

an exterior wall coaxial with the central axis and descending from a periphery of the lid;

at least one hooked catch extending upwardly from the exterior wall and inwardly toward the central axis;

a gasket mounting flange, coaxial with the central axis, descending from a bottom surface of the lid to define a gasket space between the mounting flange and the exterior wall;

a swell, aligned circumferentially with the at least one catch, protruding outwardly from the exterior wall, and defining therein a key slot into which a key is insertable, wherein defining the key slot comprises providing a recess having a nonrectilinear vertical cross-sectional shape extending radially outward through the swell; and disposing a gasket upon the gasket mounting flange, the gasket comprising:

an inside wall adjacent an inside face of the mounting flange;

an outside wall situated within the gasket space and in contact with the exterior wall; and a bottom sealing surface; and contacting the top of the container with the bottom sealing surface.

14. The method according to claim 13 further comprising the step of defining the vertical cross-sectional shape to have an arcuate shape.

15. The method according to claim 14 wherein defining the vertical cross-sectional shape further comprises the step of defining a shape of a semicircle.

16. The method according to claim 13 wherein contacting the top of the container with the bottom sealing surface comprises inserting a circumferential bead on the sealing surface into a circular channel defined in the container top.

17. The method according to claim 13 further comprising the step of engaging the at least one hooked catch with an underside of the perimetric rim.

18. The method according to claim 17 further comprising the step of integrally molding the at least one hooked catch with the exterior wall; and wherein engaging the at least one hooked catch with an underside of the perimetric rim comprises:

resiliently bending the exterior wall to displace the at least one catch radially outward from the central axis; and permitting the exterior wall to rebound radially inward to hook the catch beneath the perimetric rim.

19. The method according to claim 18 wherein the step of integrally molding the at least one hooked catch comprises molding a plurality of hooked catches, a first one of the hooked catches being aligned with the swell.

20. The method according to claim 19 wherein molding a plurality of hooked catches comprises: molding three catches and spacing the three catches around a circumference of the exterior wall.

21. The method according to claim 19 further comprising the steps of providing an opener and removing the cap from the container, wherein removing the cap comprises operatively engaging the opener with the swell by inserting a key into the key slot.

22. The method according to claim 21 wherein providing an opener comprises:

providing a handle having a first end and a second end;

supplying a key flange on an underside of the handle between the first end and the second end;

supplying a fulcrum flange on the underside of the handle at the second end; and extending the key from the key flange and toward the second end.

23. The method of claim 22 wherein removing the cap from the container further comprises the steps of:

contacting the fulcrum flange against the lid;

lifting the handle, thereby pushing the key upward in the key slot within the swell;

levering with the opener to bend the exterior wall to displace the first one of the hooked catches radially outward from the central axis, thereby disengaging the first one of the catches from the underside of the perimetric rim;

lifting the cap from the top of the container; and disengaging others of the hooked catches from the underside of the perimetric rim; and lifting the cap from the top of the container.

24. The method according to claim 23 wherein:

defining the vertical cross-sectional shape comprises defining an arcuate shape; and inserting a key comprises sliding into the key slot a key having an arcuate shape complementary to the arcuate shape of the vertical cross-sectional shape of the recess.

* * * * *